US005927392A

United States Patent [19]

Youn et al.

[11] Patent Number: 5,927,392

[45] Date of Patent: Jul. 27, 1999

[54] HEAT EXCHANGER FIN FOR AIR CONDITIONER

[75] Inventors: Baek Youn, Suwon; Young-Saeng Kim, Incheon, both of Rep. of Korea

[73] Assignee: Samsung Electronics Co., Ltd., Suwon, Rep. of Korea

[21] Appl. No.: 08/967,779

[22] Filed: Nov. 10, 1997

[30] Foreign Application Priority Data

Dec. 30, 1996 [KR] Rep. of Korea ..... 96-77587

[51] Int. Cl.[6] ..... F28F 1/32

[52] U.S. Cl. ..... 165/151; 165/DIG. 503

[58] Field of Search ..... 165/151, 182, 165/DIG. 502, DIG. 503

[56] References Cited

U.S. PATENT DOCUMENTS 4,550,776 11/1985 Lu ..... 165/151
4,832,117 5/1989 Kato et al. ..... 165/151
5,111,876 5/1992 Nash ..... 165/151
5,509,469 4/1996 Obosu ..... 165/151
5,685,367 11/1997 Jun ..... 165/151
5,706,885 1/1998 Kim ..... 165/151
5,722,485 3/1998 Love et al. ..... 165/151

*Primary Examiner*—Allen Flanigan
*Attorney, Agent, or Firm*—Burns, Doane, Swecker & Mathis, L.L.P.

[57] ABSTRACT

A heat exchanger includes parallel vertical fins through which horizontal heat exchanger tubes project. Each fin possesses groups of louver patterns, each group arranged between two vertically adjacent tubes. Each group of louver patterns is formed by first, second, third and fourth louver patterns arranged generally radially with respect to an adjacent tube. The louver patterns provide slits in the fin through which air can flow. The orientation of the louver patterns is such that a minimum vertical distance between vertically adjacent ones of the groups is shorter than an outer radius of a respective tube.

9 Claims, 5 Drawing Sheets

HEAT EXCHANGER FIN FOR AIR CONDITIONER

BACKGROUND OF THE INVENTION

1. Field of the Invention

The present invention relates to a heat exchanger for an air conditioner, and more particularly to a heat exchanger which provides an improved heat transfer performance resulting from the turbulence and mixture of the air currents that flow in spaces between a plurality of flat fins.

2. Description of the Prior Art

A conventional heat exchanger for an air conditioner includes, as shown in FIG. 1, a plurality of flat fins 1 arranged in a parallel relation to each other at predetermined intervals and a plurality of heat exchanging tubes 2 passing through the fins 1 perpendicular thereto. The air currents flow in the space defined between the fins 1 in the direction of the arrow in FIG. 1 and exchange heat with the fluid flowing in the heat exchanging tubes 2.

For a thermal fluid flowing across each flat fin 1, it has been known that the thickness of the thermal boundary layer 3 on both heat transfer surfaces of the fin 1 is gradually increased in proportion to the square root of the distance from the air current inlet end of the fin 1 as shown in FIG. 2. In this regard, the heat transfer rate of the fin 1 is remarkably reduced in proportion to the distance from the air current inlet end. Therefore, the above heat exchanger has a lower heat transfer efficiency.

For the thermal fluid flowing across each heat transfer pipe 102, it has been also known that, when lower velocity air currents flow in the direction of the arrow of FIG. 3, the air currents separate from the outer surface of the pipe 2 at portions spaced apart from the center point of outer surface of the pipe 4 at angles of 70-degree to 80-degree. Therefore, a dead air region 4 is formed behind each tube 2 in a direction of the air flow as shown by the hatched region of FIG. 3. In the dead air region 4, the heat transfer rate of the tube 2 is remarkably reduced so that the heat transfer efficiency of the above heat exchanger becomes worse.

In order to overcome the above problems, there has been proposed another solution as disclosed in U.S. application Ser. No. 08/890,562 filed on Jul. 9, 1997. This heat exchanger, as shown in FIGS. 4 and 5, includes a plurality of heat exchanging tubes 2 which are fitted into the regularly spaced flat fins 1 such that the tubes 2 are perpendicular to the fins 1.

The heat exchanger also includes a plurality of angled louver patterns which are formed adjacent the tubes 2 passing through each fin 1. The patterns located between the tubes 2 comprise: a first angled louver pattern 20 and a second louver pattern 30 inclined opposite to the first louver pattern 20. Those patterns are located in the left (upstream) half area of respective tubes 2, and include louvers projecting from both surfaces of the flat fin 1, such that air current flowing through the patterns 20, 30 becomes turbulent and mixed. A third angled louver pattern 40 and a fourth louver pattern 50 inclined opposite to the third louver pattern, are located in the right (downstream) half area of respective tubes 2, and include louvers projecting from both surfaces of the flat fin 1, such that air current flowing through those patterns 40, 50 becomes again turbulent and mixed, resulting in a reduction of the dead air region. Those louver patterns 20–50 are radially positioned around each tube 2.

Also, the angled first and second louver patterns 20 and 30 are placed in mirror image relationship to each other such that the air currents flowing over both surfaces of the flat fin 1 and in an upstream half area between two tubes 2 result in a turbulent flow and mixing. Further, the angled third and fourth louver patterns 40 and 50 are similarly placed in mirror image relationship to each other such that the resultant air current having passed the patterns 20 and 30 continues to pass the remaining half area between the tubes 2 and becomes turbulently mixed, thereby reducing the dead air region.

Each of the first and second louver patterns 20, 30 includes strips or louvers 70, each of which has a left (upstream) end 76 (see FIG. 5) projecting from a first surface 1A of the flat fin 1 and a right (downstream) end 78 projecting from a second surface 1B of the flat fin 1, respectively. Each louver provides a slit extending transversely relative to the air flow. The louvers according to the present invention may be formed by way of a cutting and twisting process. The third and fourth louver patterns 40, 50 are similar to those first and second louver patterns 20, 30, but the upstream louvers thereof project from the second surface of the fin rather than from the first surface.

A generally round base portion 60 of the fin occupies an area defined between upper ends of the first and third louver patterns 20, 40 and a lower outer circumference of a respective tube 2. With the base portion 60 interposed therebetween and concentrically relative to the tube 2, the first and third louver patterns 20, 40 are radially placed around the tube 2. Similarly, the second and fourth louver patterns 30, 50 are radially placed to face an upper outer circumference of the next lower tube 2, with a rounded base portion 60A interposed therebetween.

The first and third louver patterns 20, 40 and the second and fourth louver patterns 30, 50 are symmetrical to each other, and are separated by a base portion 60B of the fin.

The louvers 70 to 75 included in the respective patterns 20, 30, 40, 50 are sequentially arranged without there being any fin base portion therebetween and are directly formed by way of a cutting and twisting process.

In the drawings, reference numeral 80 denotes solid beads each of which extends perpendicularly to the air flow and lies in a plane PL containing the center axis of two adjacent tubes 2. The beads formed by way of the beading process serve to: drain condensed water (i.e., dew) that may be generated from the heat exchanging tubes 2, reinforce the flat fin 1, and enlarge the surface area of the flat fin 1.

The bead 80 is located in a base portion 60C disposed between the first and second patterns 20, 30 and the third and fourth patterns 40, 50.

A single bead is configured to project above the second surface 1A of the flat fin 1, and thus has a pattern symmetrical relative to a central longitudinal axis of the bead, i.e., an axis lying in the plane PL. Upstream and downstream halves 80A, 80B of the bead 80 are symmetrically bent at a suitable angle, to form an inverted V-shape as can be seen in FIG. 5.

However, for the conventional heat exchanger as described above, the first to fourth louver patterns 20 to 50, each placed at predetermined positions of the flat fin 1, have many louvers 70 to 75, e.g., as many as six in number, respectively, causing the height H and width W of each louver to be lower and narrower. Further, this results in a wide angle of 49-degrees defined between two louver patterns 30 and 50 (see FIG. 4), these patterns being horizontally symmetrical to each other, as shown in FIGS. 4 and 5.

Accordingly, at upstream and downstream ends of each tube 2, there is an area with a relatively large vertical width L in which no louvers can be formed. This acts as a cause of greatly reduced heat transfer efficiency, in spite of a lower degree of the pressure drop, as well as producing a slower rate of air current at those areas. There occurs problems of an insufficient turbulence of air current and a heat transfer efficiency remarkably reduced.

SUMMARY OF THE INVENTION

Therefore, it is an object of the present invention to provide a heat exchanger having a least number of louvers for obtaining louvers sufficiently raised in height and further having louver patterns radially spaced apart by about 29-degrees along an outer circumference of tube 2 for obtaining louvers raised in height and widened in width, this allows the area of each louver to be maximized, thereby providing an improved heat transfer performance and heat transfer efficiency, as well as promoted turbulence and faster flow rate of the air currents.

Accordingly, there is provided a heat exchanger adapted for use in an air conditioner. The heat exchanger comprises parallel vertical fins arranged in parallel and spaced apart to conduct an air flow therebetween, and horizontal heat exchanger tubes extending perpendicularly through the fins for conducting a heat exchange fluid. Each tube has a center axis lying in a vertical plane, the plane containing an axis of a vertically adjacent tube. Each fin possesses groups of louver patterns. Each group is arranged between two vertically adjacent tubes and comprises first, second, third, and fourth louver patterns arranged symmetrically with respect to the vertical plane. The first and second louver patterns are arranged upstream of the third and fourth louver patterns, respectively, with reference to a direction of air flow. The first and third louver patterns are arranged above the second and fourth louver patterns, respectively. Each of the first and third louver patterns includes a plurality of louvers forming parallel slits oriented generally radially with respect to an upper one of the two vertically adjacent tubes. Each of the second and fourth louver patterns includes a plurality of louvers forming slits oriented generally radially with respect to a lower one of the two vertically adjacent tubes. The first and second louver patterns form equal angles with respect to the third and fourth louver patterns, respectively. Those angles are in the range of 26 to 32 degrees. A minimum vertical distance between vertically adjacent ones of the groups is shorter than an outer radius of a respective tube.

BRIEF DESCRIPTION OF THE DRAWINGS

Other objects and aspects of the invention will become apparent from the following description of embodiments with reference to the accompanying drawings in which.

DETAILED DESCRIPTION OF THE PREFERRED EMBODIMENT

Figure 1:
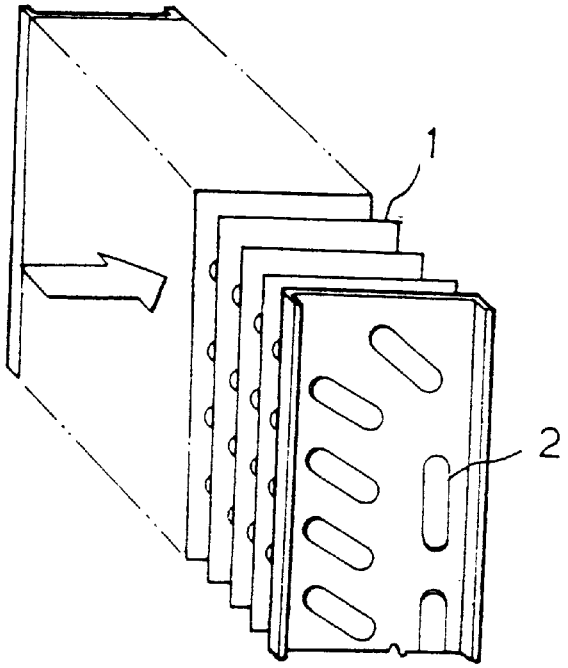
FIG. 1 (PRIOR ART)
FIG. 1 is a perspective view illustrating a conventional heat exchanger.
Figure 2:
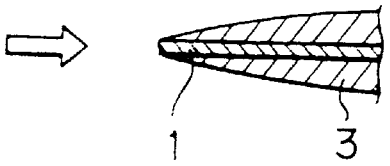
FIG. 2 (PRIOR ART)
FIG. 2 is an enlarged sectional view of a flat fin of the heat exchanger of FIG. 1, showing the characteristics of the thermal fluid flowing about the fin.
Figure 3:
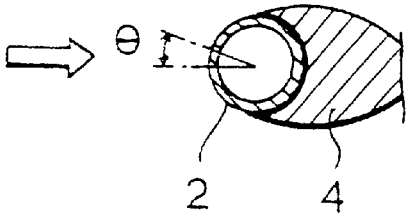
FIG. 3 (PRIOR ART)
FIG. 3 is an enlarged sectional view of a the heat exchanging tube of the heat exchanger of FIG. 1, showing the characteristics of the thermal fluid flowing about the heat exchanging tube.
Figure 4:
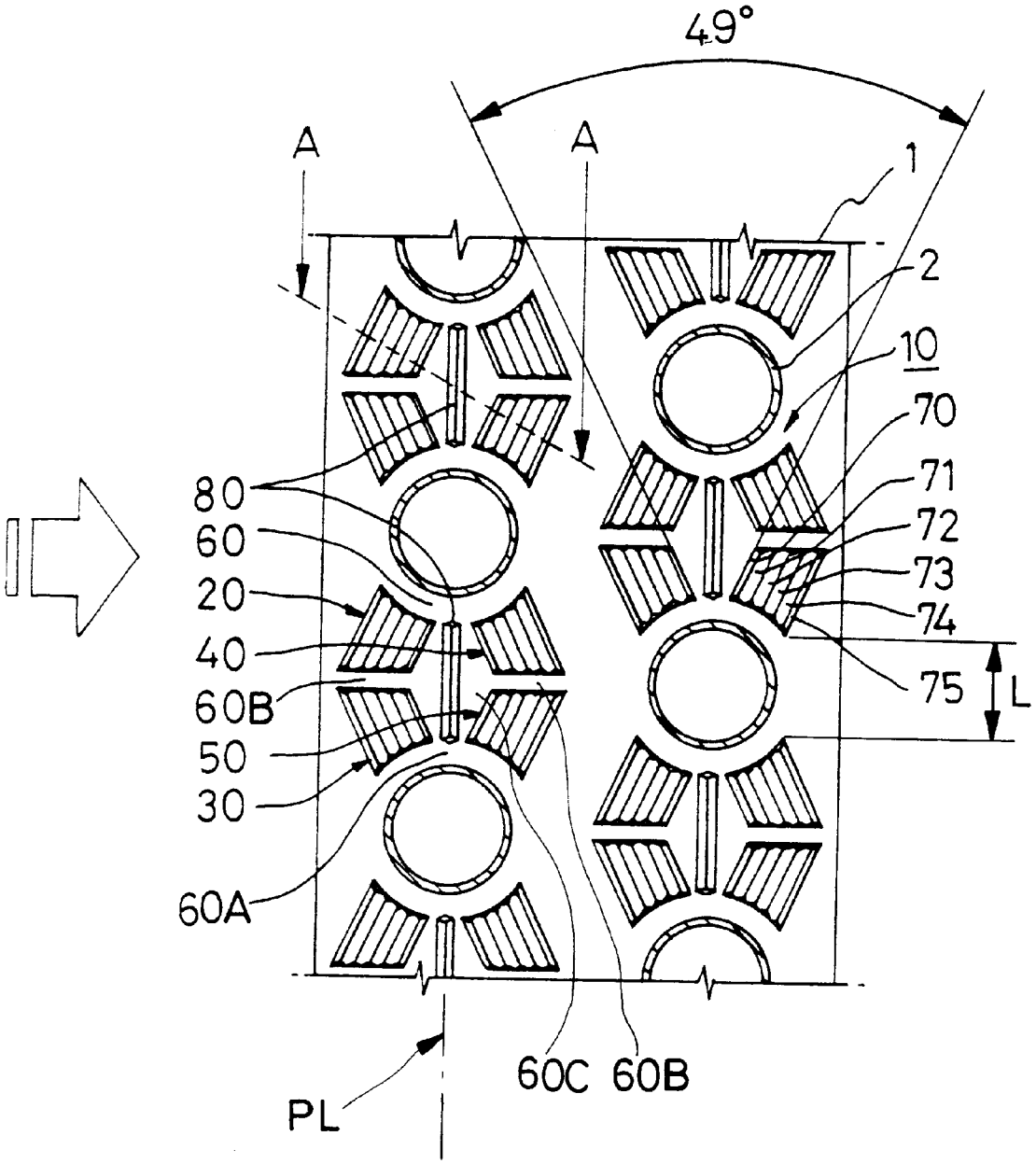
FIG. 4 is a front view of a flat fin of another conventional heat exchanger.
Figure 5:
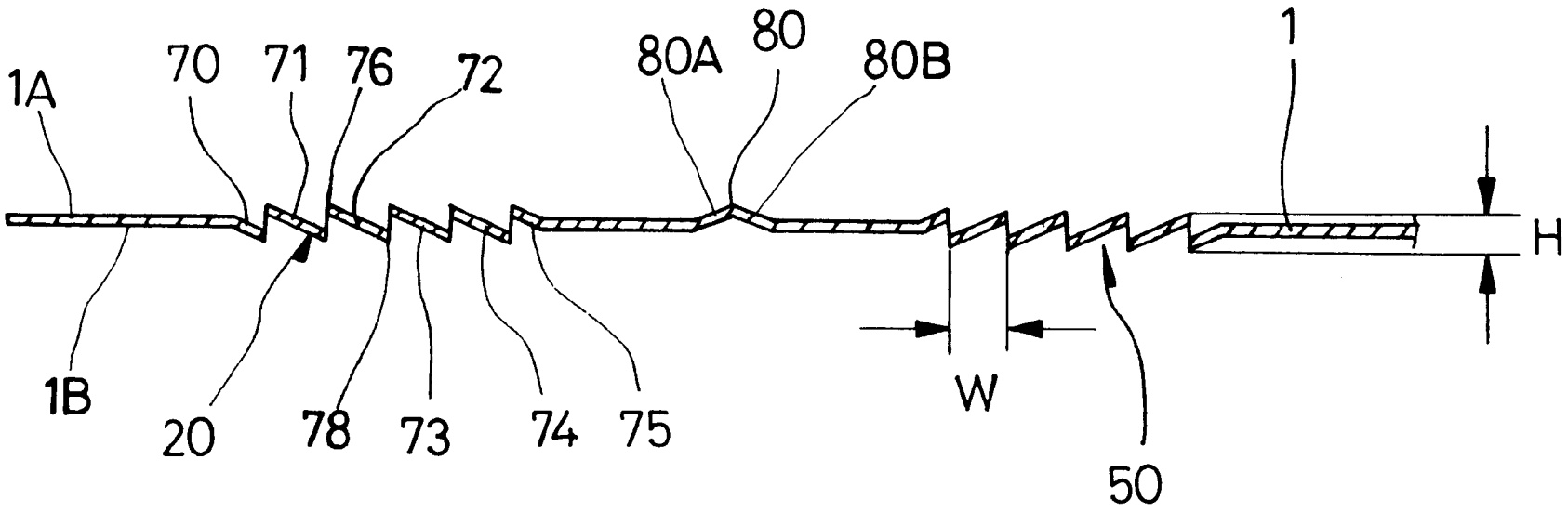
FIG. 5 is a sectional view of the flat fin taken along the section line A—A in FIG. 4.

The preferred embodiment according to the present invention will now be described in detail in accordance with the accompanying drawings. The same or corresponding elements or parts are designated with like references throughout the drawings.

In the drawing, a fin 1' is depicted and reference numeral 100 generally denotes a group of angled louver patterns formed in the fin and arranged in a space between vertically adjacent tubes 2. The louvers cause the air currents to be turbulent and mixed, which effectively reduces the size of dead air regions behind each tube 2 in a direction of the air flow and thus improves the heat transfer performance.

Figure 6:
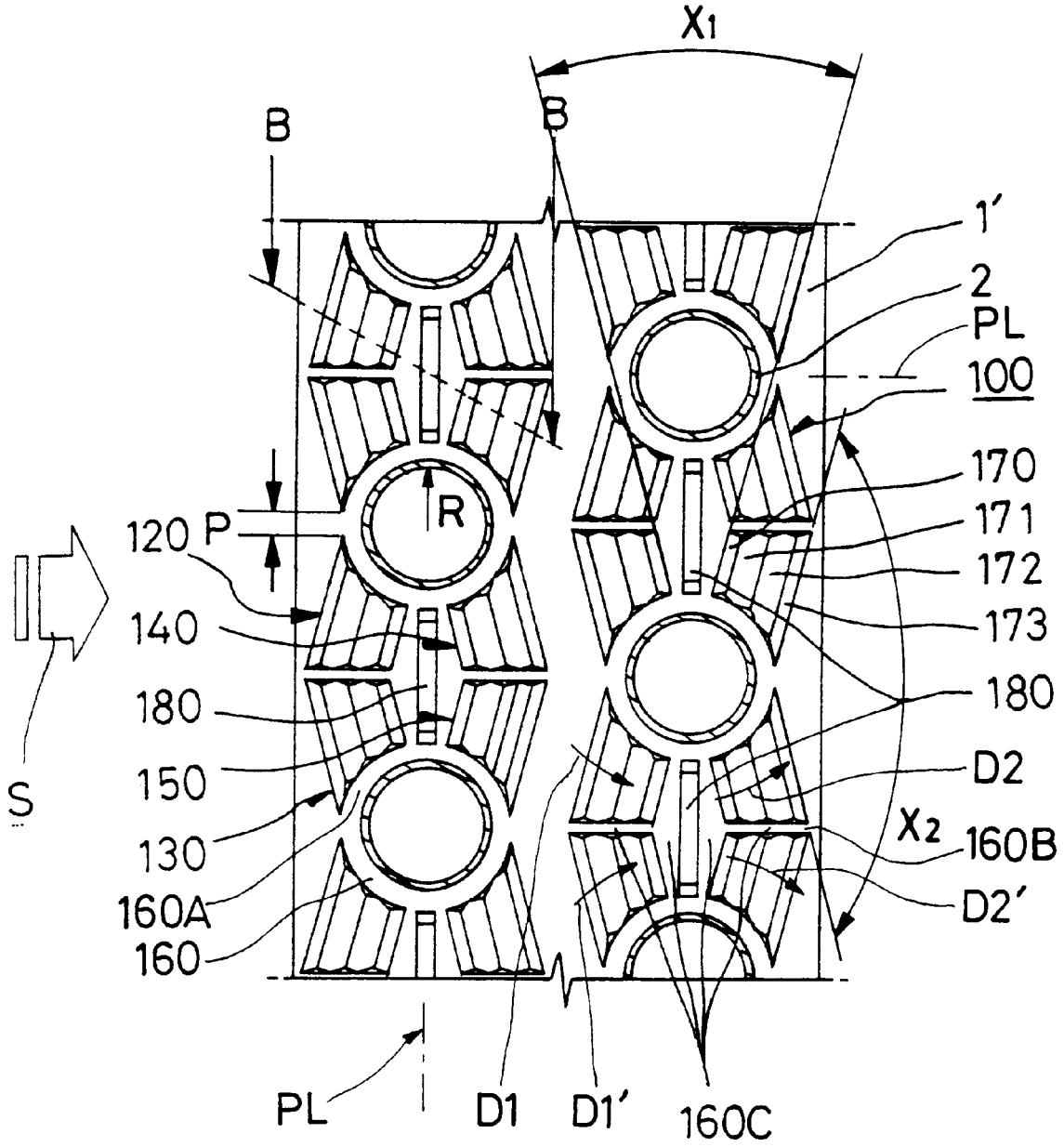
FIG. 6 is a front view of a flat fin of a heat exchanger according to the present invention.
Figure 7:
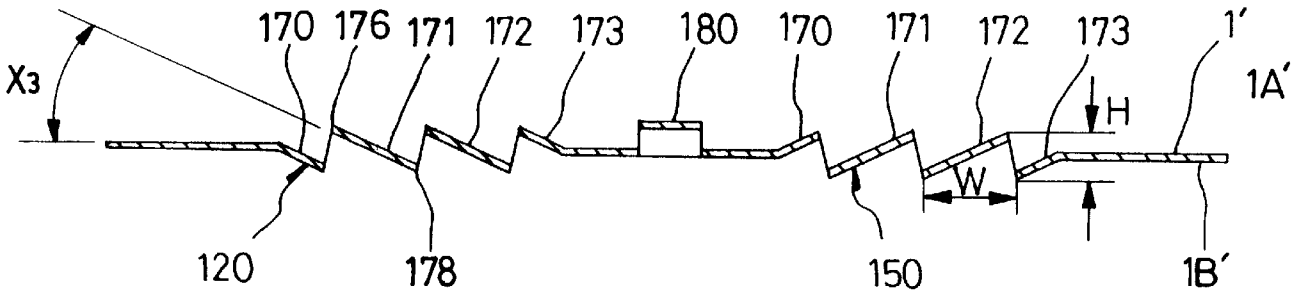
FIG. 7 is a sectional view of the flat fin taken along the section line B—B in FIG. 6.

Each of the patterns 100, shown in FIGS. 6 to 7, comprises four angled louver patterns 120, 130, 140, 150 configured to guide an air current. The first pattern 120 guides the air current in a first direction D1. The third louver pattern 140 is inclined opposite to the first louver pattern 120 such that said guided air current is redirected in a second direction D2. The second angled louver pattern 130 and fourth louver pattern 150 are also inclined opposite to one another and guide the air in directions D1' and D2', respectively.

The first and third patterns 120, 140 of one of the groups 100, together with the second and third patterns of another of the groups 100, radially encompass one of the tubes 100.

The relatively angled first and second louver patterns 120 and 130 are placed in mirror image relationship to each other such that the air currents flowing over both surfaces of the flat fin along an upstream half of each of the tubes 2 become turbulent and mixed. Further, the relatively angled third and fourth louver patterns 140 and 150 are similarly placed in mirror image relationship to each other such that the resultant air currents having passed the patterns 120 and 130 continue to pass along the remaining downstream half of the tubes 2 and become turbulent and mixed, thereby reducing the air dead regions behind the tubes.

Each of the first and second louver patterns 120, 130 has strips or louvers, each of which has an upstream end 176 projecting from a first surface 1A' of the flat fin 1' and a downstream end 178 projecting from a second surface 1B' of the flat fin. Each louver provides a slit formed transversely of the air flow. The strips of the present invention may be formed by a cutting and twisting process. The slits of the first and second louver patterns 120, 130 have their upstream ends, i.e. the slit inlets 179, arranged at the fin first surface 1A'. The third and fourth louver patterns 140, 150 are similar to those first and second louver patterns 120, 130, except that the upstream (inlet) ends 179 of the slits of the third and fourth patterns are arranged at the fin second surface 1B' (see FIG. 8).

A generally round base portion 160 of the fin 1' occupies an area defined between upper ends of the first and third louver patterns 120, 140 and a lower outer circumference of a respective tube 2. The base portion 160 is concentric with the tube 2, so the first and third louver patterns 120, 140 are radially disposed around the centered tube 2. Similarly, the second and fourth louver patterns 130, 150 are radially placed around an upper outer circumference of the next lower tube 2, with a rounded base portion 160A interposed therebetween.

The first and third louver patterns 120, 140 and the second and fourth louver patterns 130, 150 are symmetrically formed relative to each other, and are separated by a base portion 160B of the fin.

The four louvers 170 to 173 included in each of the respective patterns 120 to 150 are sequentially arranged without any fin base portion disposed therebetween and are directly formed by way of a cutting and twisting process.

In the drawings, an angle range x1 defined between the second and fourth louver patterns (and also between the first and third louver patterns) is designed to be 26-degrees≦x1≦32-degrees, i.e., in the range of 26 to 32 degrees. The louver patterns are symmetrically positioned horizontally with respect to a vertical plane PL containing the axis of a respective tube 2. Also, an angle range x2 defined between the fourth louver pattern 150 of one group and a third louver pattern 140 of the next lower group is in the range of 148 to 154 degrees, i.e., 148-degrees≦x2≦154-degrees. The same angle x2 is formed between the second louver pattern 120 of one group with the first louver pattern 120 of the next lower group. The louver patterns are symmetrically positioned vertically relative to each other with respect to a horizontal plane PL' containing the tube axis. Further, as shown in FIG. 7, an opening of respective louvers forms an angle x3 relative to the plane of the flat fin 1', in the range of 24 to 26 degrees, i.e., 24-degrees≦x3≦26-degrees.

Respective louvers 170 to 173 have a height H of more than 1 mm. The minimum vertical spacing P between vertically adjacent groups of louver patterns is less than an outer radius R of the tube 2, and preferably is less than 2 mm. Also, respective louver patterns 120 to 150 have two louvers 171 and 172 of a width more than 2 mm.

In the drawing, reference numeral 180 denotes intermediate slits extending perpendicular to the flow direction of the air currents, and disposed above and below the tubes 2. Each slit 180 lies in one of the vertical planes PL. The slits 180 are formed by way of a cutting and bending process and serve to reduce the dead air region around the tubes 2 and to make the air current turbulent.

Figure 8:
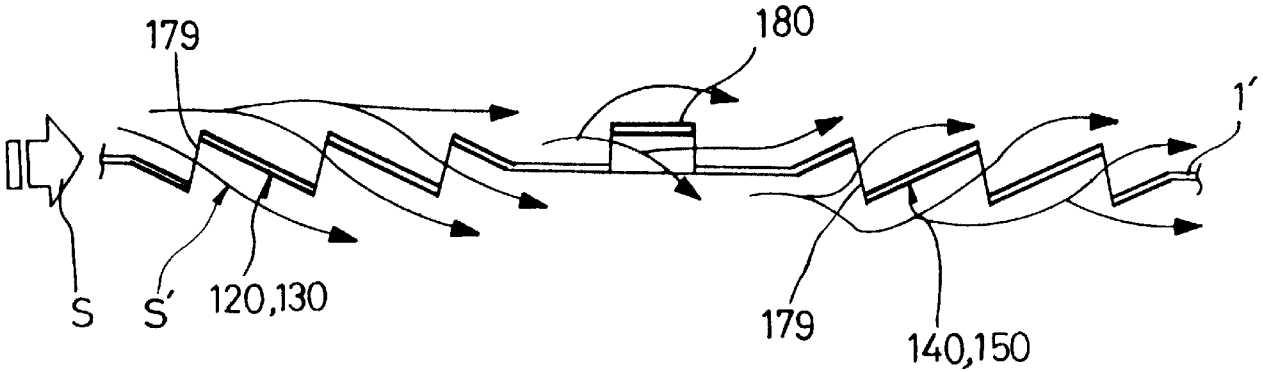
FIG. 8 is a schematic diagram explaining the air currents flow in accordance with the present invention.

The slits 180, as shown in FIG. 8, are placed in a base portion 160C disposed between the first and second louver patterns 120, 130 or the third and fourth louver patterns 140, 150, and project outwardly relative to the first surface 1A' of the flat fin 1A. Each slit 180 has upper and lower end portions and extends vertically across an area separating downstream ends of the louver patterns 120, 130 from upstream ends of respective louver patterns 140, 150. The louver patterns are radially arranged around a respective tube 2, with the fin base portions interposed therebetween.

An operation and effect of the heat exchanger for the air conditioner will be described.

When air currents flow in the space defined between the fins 1' in the direction of the arrow S in FIG. 6, the air currents pass through the first and second louver patterns 120, 130 and then through the third and fourth louver patterns 140, 150 in the direction of the arrow shown in FIG. 8. This operation allows a thermal flow from the heat exchanging tubes 2 to be continuously transferred and to be turbulent and mixed.

Portions S1 of the air currents which flow over the first surface 1A' of the flat fin 1' are diverted to flow over the second surface 1B', through the slits formed by the louvers 170 to 173 of the first and second louver patterns 120, 130, which slits are open transversely to the incoming air flows. Then, said portions S1 of the air currents are mixed with the air currents flowing over the second surface 1B' of the flat fin. This mixture produces a turbulent air flow, which results in increased air currents in the front half area of the heat exchanging tube 2. Therefore, a better heat exchanging performance occurs around the tubes 2.

Then, portions of the turbulent air currents are caused to flow back over to the first surface 1A' of the flat fin through the slits formed by the louvers 170 to 173 of the second and third louver patterns 140, 150 and become mixed with the air currents flowing over the first surface 1A'. This mixture produces more turbulent air flow. The turbulent and mixed air currents continuously flow throughout the whole area around each tube 2, and are moved towards the downstream sides of the tubes 2, resulting in a smooth flow of the air currents.

The base portions 160 and 160A interposed between the tubes 2 and the radially disposed first to fourth louver patterns 120 to 150 allow the turbulent air currents passing through said patterns 120 through 150 to further flow into the dead air regions behind the tubes. Thus, the size of the dead air regions is considerably reduced, and the heat transfer effect in the dead air regions is further improved.

As shown in FIG. 7, since the number of louvers 170 to 173 in respective first to fourth louver patterns 120 to 150 is smaller than the number in the prior art, the height H of each louver can be higher, thereby providing, in spite of a lower degree of pressure drop, there occurs an improved heat transfer performance and heat transfer efficiency, as well as promoted turbulence and faster flow rate of the air currents.

Also, it is noted that the angle range x1 defined between the louver patterns is in the range of 26–32 degrees, wherein the inclined louver patterns are horizontally symmetrically positioned to each other with respect to the plane PL. Thus, the height H and width W of each louver can be increased. Further, the physical interval P existing between upper and lower louver patterns is narrow, which means that the total area occupied by the first to fourth louver pattern 120 to 150 is maximized. Thus, heat transfer efficiency is improved, and further promoting of air turbulence is achieved.

Meanwhile, the slits 180 provide an enlargement of the surface area of the flat fin 1, and form a thermal boundary layer providing a large heat transfer coefficient which improves the heat transfer performance.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. A heat exchanger adapted for use in an air conditioner; the heat exchanger comprising parallel vertical fins spaced apart to conduct air flows therebetween, and horizontal heat exchanger tubes extending perpendicularly through the fins for conducting a heat exchange fluid; each tube having a center axis lying in a vertical plane, the plane containing an axis of a vertically adjacent tube; each fin possessing groups of louver patterns; each group arranged between two vertically adjacent tubes and comprising first, second, third and fourth louver patterns arranged symmetrically with respect to the vertical plane; the first and second louver patterns arranged upstream of the third and fourth louver patterns, respectively, with reference to a direction of air flow; the first and third louver patterns arranged above the second and fourth louver patterns, respectively; each of the first and third louver patterns including a plurality of slanted louvers forming parallel slits oriented generally radially with respect to an upper one of the two vertically adjacent tubes; each of the second and fourth louver patterns including a plurality of slanted louvers forming slits oriented generally radially with respect to a lower one of the two vertically adjacent tubes; the first and second louver patterns forming equal angels with respect to the third and fourth louver patterns, respectively, the angles being in the range of 26 to 32 degrees; a minimum vertical distance between vertically adjacent one of the groups being shorter than an outer radius of a respective tube.

2. The heat exchanger according to claim 1 wherein the first, second, third and fourth louver patterns are arranged symmetrically with respect to a horizontal plane disposed midway between the two vertically adjacent tubes.

3. The heat exchanger according to claim 2 wherein the angle constitutes a first angle, the second and fourth louver patterns of each group forming equal second angles with respect to first and third louver patterns of a next lower group; the second angle being in the range of 148 to 154 degrees.

4. The heat exchanger according to claim 1 wherein the louvers are oriented at an oblique angle relative to a plane of the fin, the oblique angle being in the range of 24 to 26 degrees.

5. The heat exchanger according to claim 1 wherein the minimum vertical distance between vertically adjacent groups is less than 2 mm.

6. The heat exchanger according to claim 1 wherein each louver includes first and second ends projecting beyond first and second sides, respectively, of the fin, a distance between the first and second ends in a direction perpendicular to a plane of the fin defining a louver height, the louver height being greater than 1 mm.

7. The heat exchanger according to claim 1 wherein a distance between the first and second louver ends in a direction parallel to a plane of the fin defines a louver width, the louver width being greater than 2 mm.

8. The heat exchanger according to claim 1, further including a vertical slit lying in the vertical plane for separating the first and second louver patterns of each group from the third and fourth louver patterns.

9. The heat exchanger according to claim 1 wherein adjacent slits in each louver pattern are separated from one another solely by an edge of a louver.

* * * * *